US007163160B2

(12) United States Patent
Liu

(10) Patent No.: US 7,163,160 B2
(45) Date of Patent: Jan. 16, 2007

(54) SPRAY GUN HEAD

(75) Inventor: Shou-Chang Liu, Hsinchuang (TW)

(73) Assignee: Chia Chung Enterprises Co., Ltd., Taipei Hsien (TW)

( * ) Notice: Subject to any disclaimer, the term of this patent is extended or adjusted under 35 U.S.C. 154(b) by 96 days.

(21) Appl. No.: 11/111,713

(22) Filed: Apr. 22, 2005

(65) Prior Publication Data

US 2006/0016909 A1 Jan. 26, 2006

(30) Foreign Application Priority Data

Jul. 23, 2004 (TW) ..... 93211678 U

(51) Int. Cl.
*B05B 1/28* (2006.01)

(52) U.S. Cl. ..... 239/296; 239/290; 239/422; 239/424; 239/428; 239/433; 239/518; 239/525; 239/600

(58) Field of Classification Search ..... 239/290, 239/296, 422, 423, 424, 428, 433, 434, 461, 239/518, 525, 526, 600
See application file for complete search history.

(56) References Cited

U.S. PATENT DOCUMENTS 2,479,507 A * 8/1949 Peeps ..... 239/600
4,478,370 A * 10/1984 Hastings ..... 239/296
4,537,357 A * 8/1985 Culbertson et al. ..... 239/290
4,712,739 A * 12/1987 Bihn ..... 239/290
4,917,300 A * 4/1990 Gloviak et al. ..... 239/290
5,344,078 A * 9/1994 Fritz et al. ..... 239/296
6,471,144 B1 * 10/2002 Huang ..... 239/296
6,547,160 B1 * 4/2003 Huang ..... 239/290
6,612,506 B1 * 9/2003 Huang ..... 239/290
6,685,106 B1 * 2/2004 van der Steur ..... 239/296
6,793,155 B1 * 9/2004 Huang ..... 239/296
6,854,667 B1 * 2/2005 Ulrich et al. ..... 239/600

* cited by examiner

*Primary Examiner*—Steven J. Ganey
(74) *Attorney, Agent, or Firm*—Bacon & Thomas, PLLC

(57) ABSTRACT

A spray gun head comprises a flow distribution mechanism having an annular shield member disposed around a nozzle thereof and a plurality of apertures around the flow distribution mechanism; a cap comprising a central orifice and two pairs of holes at two opposite sides thereof, such that a mouth of the nozzle is adapted to dispose in the orifice when the cap is put on the flow distribution mechanism; and a ring threadedly secured onto the flow distribution mechanism for closing a pass between the rear of the cap and the flow distribution mechanism. By utilizing this spray gun head, both air flow and air pressure leaving the flow distribution mechanism are made uniform for obtaining an excellent spray on balance and atomization.

2 Claims, 4 Drawing Sheets

SPRAY GUN HEAD

FIELD OF THE INVENTION

The present invention relates to spray guns, more particularly to a head of a spray gun comprising a flow distribution mechanism, a cap and a ring, where a creative design is provided on a nozzle of the flow distribution mechanism for simplifying the construction of the nozzle, enabling the inner design of the cap to be matingly engaged with the nozzle and making both air flow and air pressure leaving the head of the spray gun uniformly due to the configuration of the nozzle in order to overcome the inadequacy of the prior art.

BACKGROUND OF THE INVENTION

People are familiar with the head of a spray gun. A wide variety of heads of different specifications are available. The head designed specifically for mounting on a spray gun is able to shoot out a spray of liquid (e.g., paint) contained in the spray gun to the surface of any object. The object thus can present a particular pattern on its surface. The head of a conventional spray gun is described in detail below.

Referring to FIGS. 1 and 2, the head 10 of the spray gun 1 comprises a flow distribution mechanism 11, a cap 12, and a ring 13. The flow distribution mechanism 11 is disposed forwardly of the spray gun 1. Pressurized air in the spray gun 1 is adapted to travel to the flow distribution mechanism 11. The flow distribution mechanism 11 comprises external threads 111, a central nozzle 112, a plurality of first apertures 113 equally spaced around a rear surface of the nozzle 112, an annular projection 115 around the nozzle 112 (see FIG. 2), a plurality of second apertures 116 equally spaced around a front surface of the nozzle 112 proximate the projection 115, a disc 117 on a front surface of the projection 115, the disc 117 having a diameter slightly smaller than that of the nozzle 112, a central mouth 118 disposed forwardly of the disc 117, the mouth 118 being an opening of a liquid (e.g., paint) channel in the spray gun 1, and a plurality of third apertures 119 equally spaced around an annular edge of the disc 117 distal to the mouth 118. In operation, pressurized air enters the flow distribution mechanism 11 of the spray gun 1 prior to exiting via the first apertures 113, the second apertures 116, and the third apertures 119 sequentially.

The cap 12 comprises a central orifice 121 and two pairs of holes 122 at two opposite sides of the orifice 121, the holes 122 of the same pair being spaced by a predetermined distance such that the mouth 118 is adapted to dispose in the orifice 121 when the cap 12 is put on the flow distribution mechanism 11 and a predetermined gap exists between rear of the cap 12 and the surface of the flow distribution mechanism 11 after mounting. The cap 12 further comprises two forward opposite yoke arms 123 spaced from both sides of the orifice 121, and two pairs of first openings 124 each on the yoke arm 123 and being in fluid communication with either second opening 125 within the cap 12 (see FIG. 2). Inner surface of the cap 12 is shaped as a staged one with different diameters so as to matingly engage with the flow distribution mechanism 11.

The ring 13 comprises inner threads 131 adapted to threadedly secure to outer threads 111 of the flow distribution mechanism 11 for mounting the ring 13 around the flow distribution mechanism 11 and closing the gap between the rear of the cap 12 and the flow distribution mechanism 11. In operation, pressurized air in the flow distribution mechanism 11 may exit the spray gun 1 by passing both a first path from the first apertures 113 to the first openings 124, a second path from the second apertures 116 to the orifice 121 via the third apertures 119, and a third path from the second apertures 116 to the holes 122 via the third apertures 119 respectively (see FIG. 2).

However, the prior head 10 of the spray gun 1 suffered from a disadvantage due to its construction. For example, pressure of air leaving any group of the orifice 121, the holes 122, and the first openings 124 is not the same as that of either one of the remaining two groups. As a result, poor atomization occurs when paint leaving the mouth 118 mixes with the air. Thus, the prior head 10 of the spray gun 1 is not satisfied.

Reasons of the disadvantage can be fully understood by referring to FIG. 2 specifically. For path from the first aperture 113 to the first opening 124 via the second opening 125, air leaving the first aperture 113 may impinge on edge of the second opening 125 irrespective of whether the first aperture 113 is aligned with the second opening 125 or not. As an end, pressure within the head 10 is not balanced.

Moreover, the above occurs in the path from the second aperture 116 to the orifice 121 or the hole 122 via the third aperture 119. In detail, air leaving the second aperture 116 may impinge on edge of the orifice 121 or the hole 122. Similarly, pressure within the head 10 is not balanced. Such poor atomization of the spray gun 1 caused by not streamline internal components thereof is thus required to improve in order to overcome the inadequacy of the prior art.

It is understood that spray gun market is very large and competitive. It is also understood that for a manufacturer of the trade quality product with advanced features is the key to win over other competitive ones. Thus, continuing improvements in the exploitation of spray gun head should be constantly sought by manufacturers of the trade.

The above and other objects, features and advantages of the present invention will become apparent from the following detailed description taken with the accompanying drawings.

SUMMARY OF THE INVENTION

After considerable research and experimentation, a spray gun head according to the present invention has been devised so as to overcome the above drawback of the prior art. The drawback is poor atomization occurs when paint leaving the mouth mixes with the air as a result of imbalanced pressure within the head and which is caused by pressure of air leaving any group of the orifice, the holes, and the first openings is not the same as that of either one of the remaining two groups. Such drawback really bothers a user in operating the spray gun.

It is an object of the present invention to provide a spray gun head without the drawback associated with the prior art spray gun head. The drawback is poor atomization of the spray caused by imbalanced pressure within the head due to not streamline internal components thereof. The head comprises a flow distribution mechanism comprising a nozzle, an annular shield member disposed around the nozzle, an annular gap between an inner edge of the shield member and a rear of the nozzle, a flange having an inclined surface on an outer edge of the shield member opposing the surface of the flow distribution mechanism, and a plurality of apertures equally spaced around an annular edge of the flow distribution mechanism proximate the inclined surface of the flange; a cap comprising a central orifice and two pairs of holes at two opposite sides of the orifice, the holes of the same pair being spaced by a predetermined distance such that a mouth of the nozzle is adapted to dispose in the orifice when the cap is put on the flow distribution mechanism, two forward opposite yoke arms spaced from both sides of the orifice, two pairs of first openings on the yoke arms, and two rear second opening in the cap each in fluid communication with the pair of the first opening; and a ring threadedly secured onto the flow distribution mechanism for closing a pass between the rear of the cap and the flow distribution mechanism such that air entering the flow distribution mechanism will exit the spray gun by passing a first path from the aperture to the first openings via the second opening, a second path from the gap to the orifice, and a third path from the gap to the holes respectively. By utilizing this spray gun head, both air flow and air pressure leaving the flow distribution mechanism are made uniform for obtaining an excellent spray, resulting in an elimination of the drawback associated with the prior spray gun head.

It is another object of the present invention to provide a spray gun head with a novel nozzle of simplified construction in which the shield member comprises a conic surface on its inner edge adjacent the annular gap, and a coaxial, hollow, cylindrical member, formed in the cap and projected from the rear of the cap, comprising an annular slope on its rear end, the annular slope of the cylindrical member being adapted to matingly engage with the conic surface of the shield member for streamlining flow paths formed by putting the cap on the flow distribution mechanism.

The above and other objects, features and advantages of the present invention will become apparent from the following detailed description taken with the accompanying drawings.

DETAILED DESCRIPTION OF THE PREFERRED EMBODIMENTS

Figure 1:
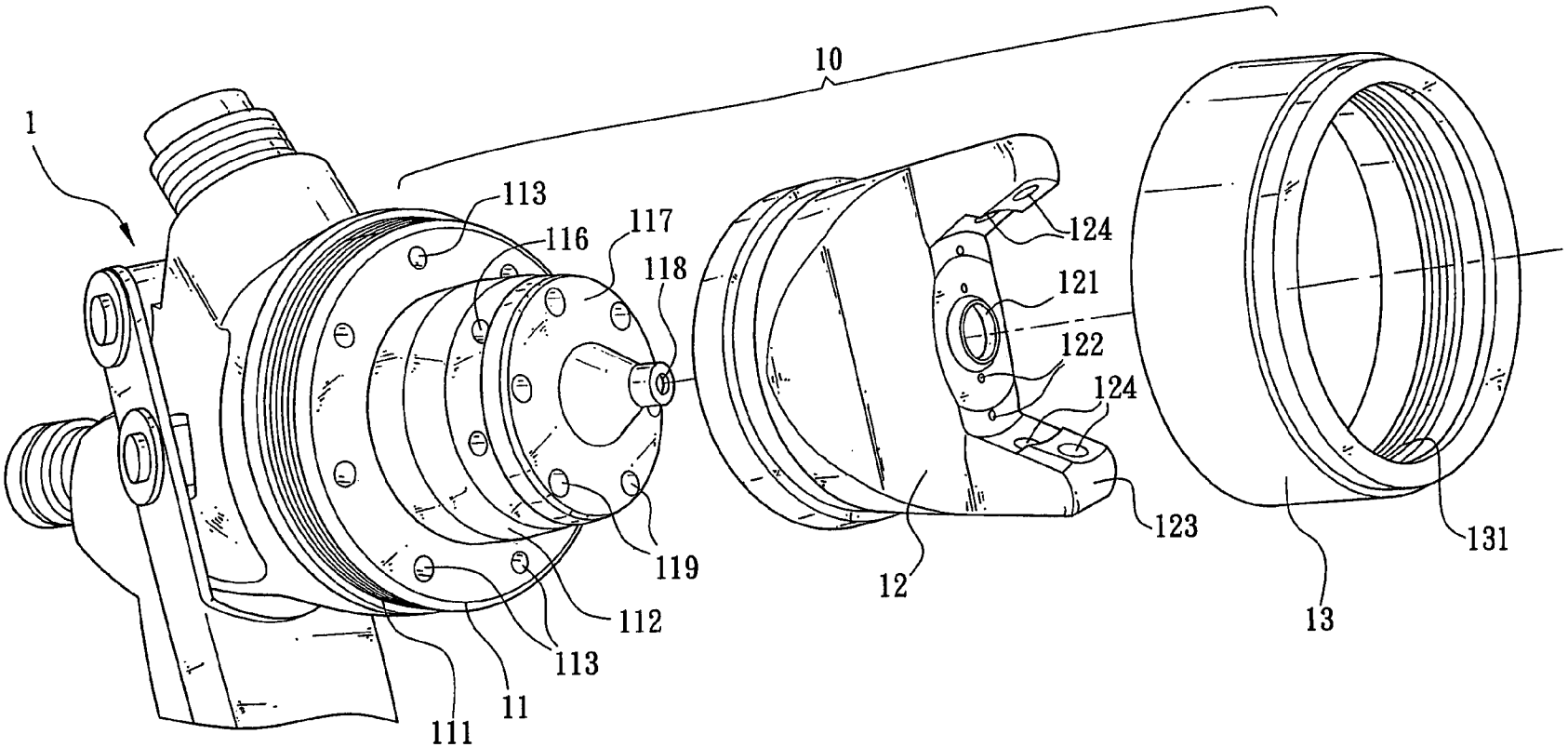
FIG. 1 (Prior Art)
FIG. 1 is an exploded view of a conventional spray gun head.
Figure 2:
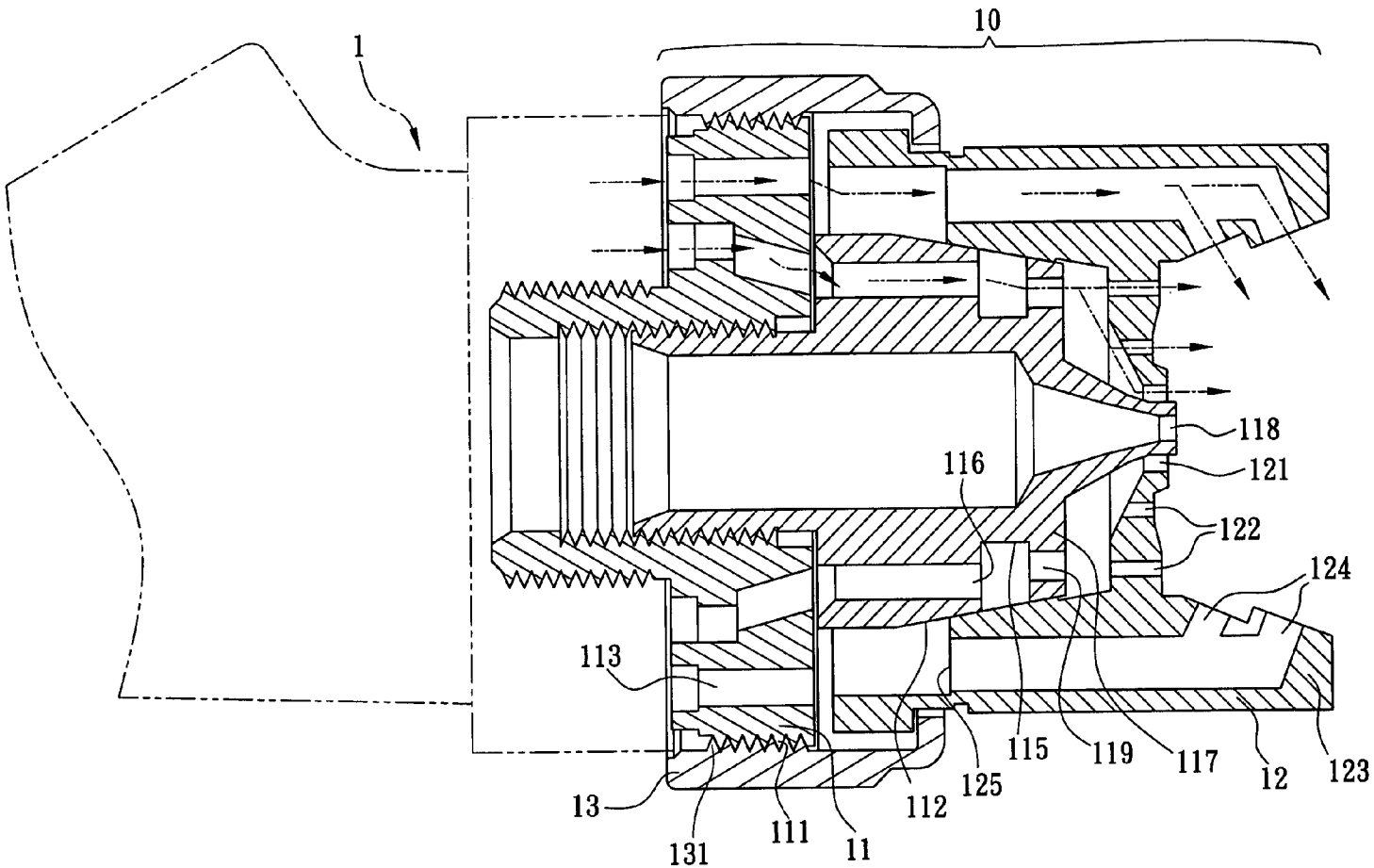
FIG. 2 (Prior Art)
FIG. 2 is a sectional view of the assembled spray gun head in FIG. 1.
Figure 3:
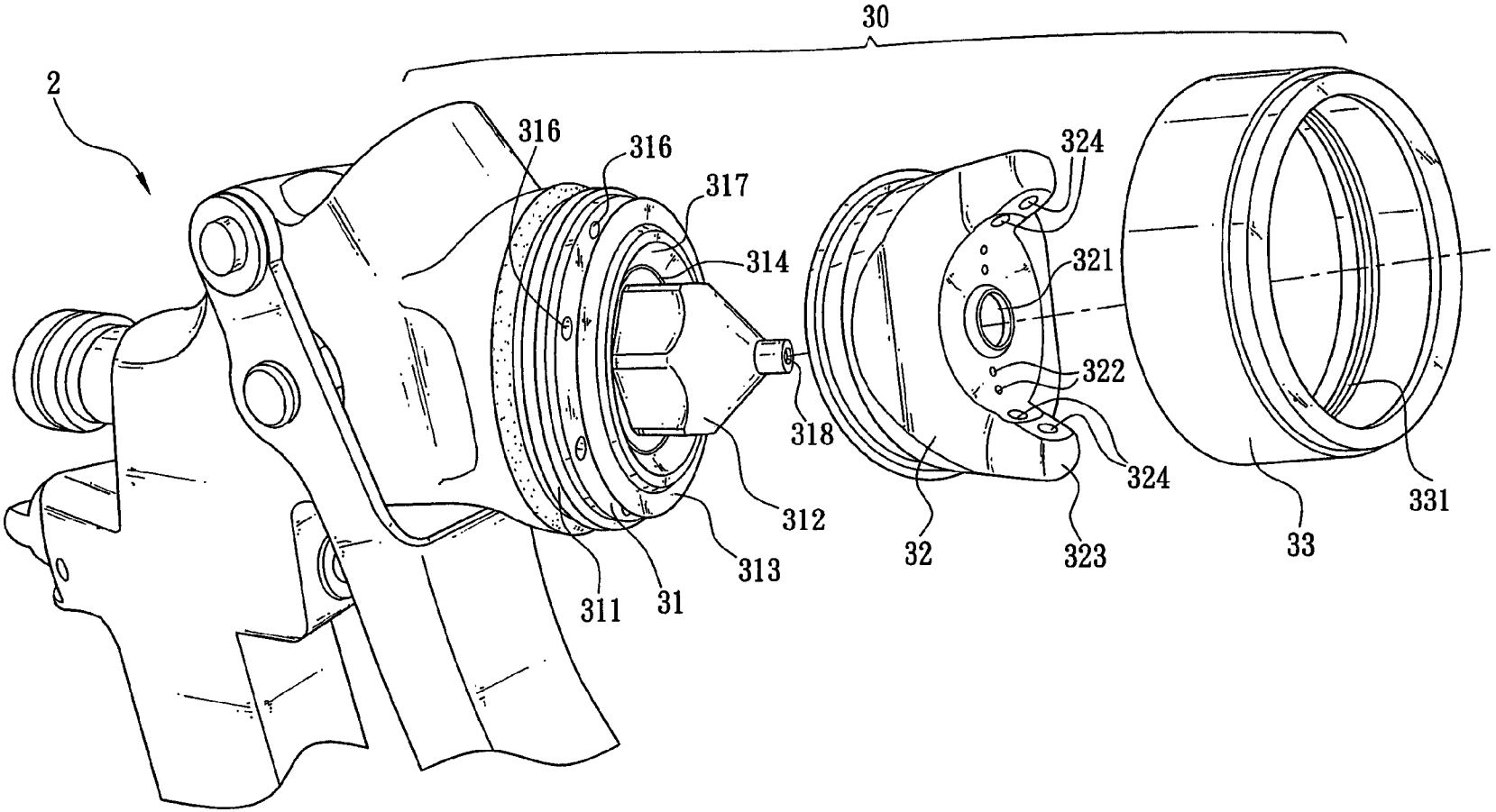
FIG. 3 is an exploded view of a preferred embodiment of spray gun head according to the invention.
Figure 4:
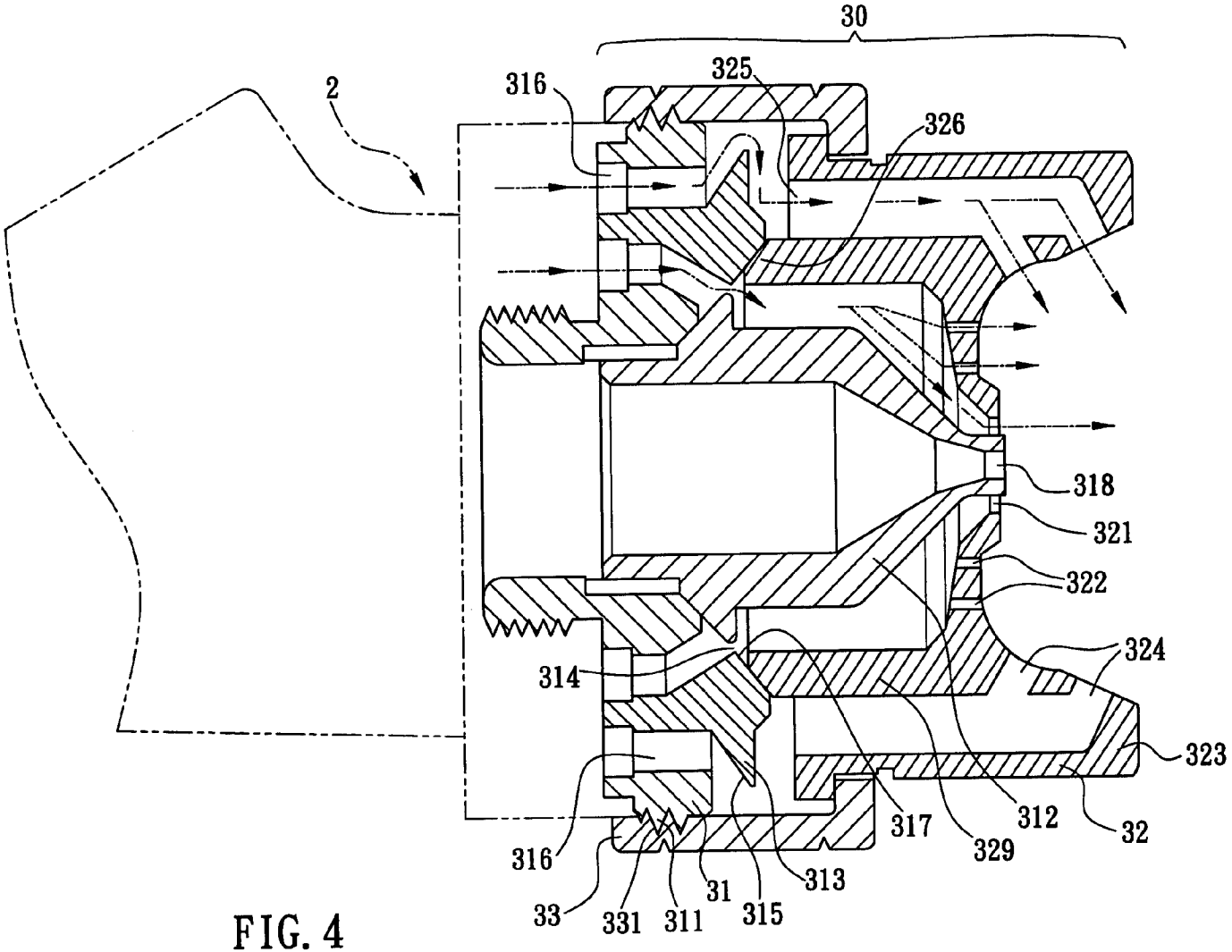
FIG. 4 is a sectional view of the assembled spray gun head in FIG. 3.

Referring to FIGS. 3 and 4, there is shown a spray gun head 30 according to a preferred embodiment of the invention. The head 30 comprises a flow distribution mechanism 31, a cap 32, and a ring 33. The flow distribution mechanism 31 is disposed forwardly of the spray gun 2. Pressurized air in the spray gun 2 is adapted to travel to the flow distribution mechanism 31. The flow distribution mechanism 31 comprises external threads 311, a central nozzle 312, and a central mouth 318 in a forward end of the nozzle 312, the mouth 318 being an opening of a liquid (e.g., paint) channel in the spray gun 2.

In the invention, an annular shield member 313 is formed on the surface of the flow distribution mechanism 31 externally of the nozzle 312. An annular gap 314 is formed between an inner edge of the shield member 313 and rear of the nozzle 312. A flange 315 with an inclined shape is formed on an outer edge of the shield member 313 opposing the surface of the flow distribution mechanism 31 (see FIG. 4). A plurality of apertures 316 are equally spaced around an annular edge of the flow distribution mechanism 31 proximate the inclined shape of the flange 315. A conic surface 317 is formed on the inner edge of the shield member 313 adjacent the gap 314. By configuring as above, pressurized air enters the flow distribution mechanism 31 of the spray gun 2 prior to exiting from the apertures 316 and the gap 314 respectively in operation.

The cap 32 comprises a central orifice 321 and two pairs of holes 322 at two opposite sides of the orifice 321, the holes 322 of the same pair being spaced by a predetermined distance such that the mouth 318 is adapted to dispose in the orifice 321 when the cap 32 is put on the flow distribution mechanism 31. The cap 32 further comprises two forward opposite yoke arms 323 spaced from both sides of the orifice 321, and two pairs of first openings 324 each on the yoke arm 323 and being in fluid communication with either rear second opening 325 within the cap 32 (see FIG. 4). A coaxial, hollow, cylindrical member 329 is formed in the cap 32 and is projected from the rear of the cap 32. An annular slope 326 is formed on a rear end of the cylindrical member 329. The annular slope 326 of the cylindrical member 329 in the cap 32 is adapted to matingly engage with the conic surface 317 of the shield member 313 (see FIG. 4). By configuring as above, flow paths formed by putting the cap 32 on the flow distribution mechanism 31 can be made streamline.

The ring 33 comprises inner threads 331 adapted to threadedly secure to outer threads 311 of the flow distribution mechanism 31 for mounting the ring 33 around the flow distribution mechanism 31 and closing the gap between the rear of the cap 32 and the flow distribution mechanism 31. In operation, pressurized air in the flow distribution mechanism 31 may exit the spray gun 2 by passing a first path from the aperture 316 to the first openings 324 via the second opening 325, a second path from the gap 314 to the orifice 321, and a third path from the gap 314 to the holes 322 respectively (see FIG. 4).

Referring to FIG. 4 again, it is clear from the above configuration that air in the head 2 entering the flow distribution mechanism 31 and leaving the apertures 316 will impinge on the inclined surface of the flange 315 of the shield member 313 (i.e., deflected) prior to exiting the first openings 324 via the second opening 325 in the first path. In either the second or third path, air entering the flow distribution mechanism 31 and leaving the gap 314 will exit the orifice 321 or the holes 322. In short, simplified nozzle 312 of the flow distribution mechanism 31 and the provisions of both the shield member 313 and the gap 314 are contemplated by the invention. As such, both air flow and air pressure leaving the flow distribution mechanism 31 are made uniform due to streamlined internal configuration. As a result, excellent atomization occurs when paint leaving the mouth 318 mixes with the air.

In view of the above, both air flow and air pressure leaving the flow distribution mechanism 31 are made uniform due to the provisions of both the shield member 313 and the gap 314 in the flow distribution mechanism 31, resulting in an excellent spray. The head 30 of the spray gun 2 of the invention is thus very applicable and can eliminate drawbacks associated with the prior spray gun head.

While the invention herein disclosed has been described by means of specific embodiments, numerous modifications and variations could be made thereto by those skilled in the art without departing from the scope and spirit of the invention set forth in the claims.

What is claimed is:

1. A head device mountable on a spray gun comprising:

a flow distribution mechanism disposed forwardly of the spray gun and being adapted to allow air in the spray gun travel thereto, the flow distribution mechanism comprising external threads, a central nozzle, a mouth in a forward end of the nozzle, the mouth being an opening of a paint channel in the spray gun, an annular shield member on a surface of the flow distribution mechanism externally of the nozzle, an annular gap between an inner edge of the shield member and a rear of the nozzle, a flange having an inclined shape on an outer edge of the shield member opposing the surface of the flow distribution mechanism, and a plurality of apertures equally spaced around an annular edge of the flow distribution mechanism proximate the inclined shape of the flange such that air entering the flow distribution mechanism will exit from the apertures and the gap respectively;

a cap comprising a central orifice and two pairs of holes at two opposite sides of the orifice, the holes of the same pair being spaced by a predetermined distance such that the mouth is adapted to dispose in the orifice when the cap is put on the flow distribution mechanism, two forward opposite yoke arms spaced from both sides of the orifice, two pairs of first openings on the yoke arms, two rear second openings in the cap each in fluid communication with the pair of the first openings, and a coaxial, hollow cylindrical member in the cap, the cylindrical member including an annular projection protruding from a rear of the cap to a central portion of the flow distribution mechanism adjacent the gap; and a ring comprising inner threads adapted to threadedly secure to the outer threads of the flow distribution mechanism for mounting the ring around the flow distribution mechanism and closing a pass between the rear of the cap and the flow distribution mechanism such that air entering the flow distribution mechanism will exit the spray gun by passing a first path from the aperture to the first openings via the second opening, a second path from the gap to the orifice, and a third path from the gap to the holes respectively.

2. The head device of claim 1, wherein the shield member comprises a conic surface on its inner edge adjacent the gap, and the cylindrical member further comprises an annular slope on its rear end, the annular slope of the cylindrical member being adapted to matingly engage with the conic surface of the shield member for streamlining flow paths formed by putting the cap on the flow distribution mechanism.

* * * * *